US010508655B2

(12) United States Patent
Volmer et al.

(10) Patent No.: US 10,508,655 B2
(45) Date of Patent: Dec. 17, 2019

(54) BLOWER FILTER SYSTEM

(71) Applicant: Dräger Safety AG & Co. KGaA, Lübeck (DE)

(72) Inventors: Achim Volmer, Lübeck (DE); Björn Ehler, Lübeck (DE); Stefan Freyher, Selmsdorf (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 760 days.

(21) Appl. No.: 14/892,382

(22) PCT Filed: May 27, 2014

(86) PCT No.: PCT/EP2014/060948
§ 371 (c)(1),
(2) Date: Nov. 19, 2015

(87) PCT Pub. No.: WO2014/191400
PCT Pub. Date: Dec. 4, 2014

(65) Prior Publication Data

US 2016/0090989 A1 Mar. 31, 2016

(30) Foreign Application Priority Data

May 27, 2013 (DE) ..... 10 2013 008 901

(51) Int. Cl.
*F04D 27/00* (2006.01)
*F04D 29/28* (2006.01)
(Continued)

(52) U.S. Cl.
CPC ..... *F04D 27/001* (2013.01); *A62B 7/10* (2013.01); *A62B 9/006* (2013.01); *A62B 18/006* (2013.01);
(Continued)

(58) Field of Classification Search
CPC . A62B 17/00; A62B 17/006; A62B 23/00–06; A62B 9/006; A62B 9/04;
(Continued)

(56) References Cited

U.S. PATENT DOCUMENTS 5,303,701 A * 4/1994 Heins ..... A62B 18/006 128/204.22
5,810,001 A * 9/1998 Genga ..... A61M 16/183 128/202.27
5,906,203 A * 5/1999 Klockseth ..... A62B 18/006 128/201.25
8,118,025 B2 2/2012 Becker et al.
(Continued)

FOREIGN PATENT DOCUMENTS

DE 10 2008 042 677 A1 4/2010
EP 0 536 546 A1 4/1993
(Continued)

OTHER PUBLICATIONS

Green-Armytage, Paul. A Colour Alphabet and the Limits of Colour Coding. Aug. 10, 2010. Colour: Design and Creativity (5):10, 1-23.*

(Continued)

*Primary Examiner* — Scott J Medway
*Assistant Examiner* — Jacqueline M Pinderski
(74) *Attorney, Agent, or Firm* — McGlew and Tuttle, P.C.

(57) ABSTRACT

A blower filter system (10) includes a blower filter device (20) with a blower (22), with a filter mount (24) and with a tube port (26) for connecting a respirator device (40) by a tube (42). The filter mount (24) is designed to receive a filter (30), on which a color coding (32) with a color specific to the pneumatic resistance of the filter (30) is arranged, and the blower filter device (20) has an optical sensor device (50) for recognizing different colors of the color coding (32).

14 Claims, 7 Drawing Sheets

(51) Int. Cl.

| | |
|---|---|
| ***F04D 29/42*** | (2006.01) |
| ***F04D 29/62*** | (2006.01) |
| ***F04D 29/70*** | (2006.01) |
| ***A62B 9/00*** | (2006.01) |
| ***A62B 18/00*** | (2006.01) |
| ***A62B 7/10*** | (2006.01) |

(52) U.S. Cl.
CPC ..... *F04D 29/281* (2013.01); *F04D 29/4206* (2013.01); *F04D 29/62* (2013.01); *F04D 29/701* (2013.01)

(58) Field of Classification Search
CPC ..... A62B 18/08; A62B 18/088; A62B 23/02; A62B 19/00; A62B 19/02; A62B 7/00; A62B 7/10; A62B 18/003; A62B 18/006; A61M 16/0003; A61M 16/0051; A61M 16/0057–0084; A61M 16/105–107; A61M 16/08; A61M 16/0816; A61M 16/0875; A61M 16/0883; A61M 16/0891; A61M 2205/125; A61M 2205/126; A61M 2205/14; A61M 2205/3306; A61M 2205/6063; F04D 27/001; F04D 29/281; F04D 29/4206; F04D 29/62; F04D 29/701
See application file for complete search history.

(56) References Cited

U.S. PATENT DOCUMENTS

| | | | | |
|---|---|---|---|---|
| 8,403,291 | B2 * | 3/2013 | Howlett | A61M 39/286 251/7 |
| 2005/0247194 | A1 * | 11/2005 | Kang | B01D 46/0086 95/19 |
| 2008/0127979 | A1 * | 6/2008 | Becker | A62B 17/04 128/205.27 |
| 2008/0245236 | A1 | 10/2008 | Ternite et al. | |
| 2009/0266361 | A1 * | 10/2009 | Bilger | A62B 7/10 128/204.21 |
| 2010/0059057 | A1 * | 3/2010 | Tapppehoon | A61M 16/08 128/204.18 |
| 2011/0114093 | A1 | 5/2011 | Patil et al. | |
| 2011/0231044 | A1 | 9/2011 | Fassnacht | |

FOREIGN PATENT DOCUMENTS

| | | |
|---|---|---|
| EP | 2 266 446 A1 | 12/2010 |
| EP | 2 322 249 A1 | 5/2011 |

OTHER PUBLICATIONS

Color Sensor. Network of Excellence Robotics and Mechatronics HomeLab Community website.*
Office Depot. Avery Removeable Round Color-Coding Labels, ¾" Diameter, Assorted Colors, Pack of 1,008. Retreieved through WayBack Machine.*

* cited by examiner 40
42
10
20

BLOWER FILTER SYSTEM

CROSS REFERENCE TO RELATED APPLICATIONS

This application is a United States National Phase Application of International Application PCT/EP2014/060948 filed May 27, 2014 and claims the benefit of priority under 35 U.S.C. § 119 of German Patent Application 10 2013 008 901.8 filed May 27, 2013 the entire contents of which are incorporated herein by reference.

FIELD OF THE INVENTION

The present invention pertains to a blower filter system with a blower filter device, having a blower, a filter mount and a tube connection, a filter for use in such a blower filter system, as well as to a method for determining the pneumatic resistance of a blower filter system.

BACKGROUND OF THE INVENTION

It is known, in principle, that blower filter systems are used in situations in which breathing protection is needed. These usually have a blower filter device, in which a blower is arranged for generating an essentially constant volume flow of air. To ensure that only the volume flow being delivered is made available for breathing by the particular person being protected, this person has a respirator device, e.g., in the form of a breathing mask or a respirator hood, placed on his head. The volume flow is delivered by the blower filter device through a tube to the respirator device. The air drawn in is drawn in through a filter in the filter mount in order to achieve a corresponding protective effect. The filters differ especially concerning the substance to be filtered. Filters can be distinguished, in principle, as gas filters and particle filters as well as combined filters, which can filter out gases and particles. The filter capacity decreases in combined filters (in the particle filter part) and in particle filters over the time during which the filter becomes clogged with particles. This reduction in the filter capacity is accompanied by an increased pressure loss, so that an ever-increasing pressure loss is provided through the filter over the duration of use of such a particle filter or of such a combined filter. The blower is then adjusted in prior-art blower devices in order to make it possible to make a constant volume flow available along a characteristic despite the increased pressure loss.

However, the display of the residual capacity is disadvantageous in prior-art blower filter systems. Thus, the residual capacity of a filter is usually calculated by the determined pressure loss of the entire blower filter system. A determination of the pressure loss and hence of the pneumatic resistance of the entire blower filter system is determined in this case as an input variable and compared with the capacity of the blower. The difference of these two parameters forms a basis for the calculation of the residual capacity. The maximum blower value (e.g., 10 mbar) is set as the maximum and a fixed parameter, e.g., approx. 3 mbar, is set as the start value in prior-art calculation systems. However, filters used in different manners have different pneumatic resistances. Filters that have not been used up hitherto consequently have different pneumatic resistances, so that the starting point in the above-described calculation model is, in reality, variable, and depends specifically on the filter. If an especially densely packed filter with a correspondingly high pneumatic resistance is used, a parameter value that is not real but fictitious and is false in this case is used for the start of the value of the capacity for displaying the residual capacity in case of prior-art calculation methods. It may thus happen that the entire system with a densely packed filter already has a basic pressure loss of about 7 mbar while the filter is not used up and correspondingly only a basic overall capacity of 3 mbar to about 10 mbar of the maximum blower capacity is available. However, if the residual capacity is calculated on the basis of a fixed preset value as a starting value of approx. 3 mbar, a corresponding display incorrectly shows that a large portion of the filter has already been used up when using a fresh and unused filter. This leads to reduced acceptance of such a system. In particular, the confidence in the display and hence also in the entire blower filter system as a protective device is reduced. Such an incorrect display possibly also causes the unused filter to be treated as being defective and incorrectly as a reject.

SUMMARY OF THE INVENTION

An object of the present invention is to eliminate the above-described drawbacks at least partially. In particular, the object of the present invention is to guarantee the most accurate and preferably undistorted display of the residual capacity of the filter in a cost-effective and simple manner.

Features and details that are described in connection with the blower filter system according to the present invention also apply, of course, in connection with the filter according to the present invention as well as the method according to the present invention and each vice versa, so that reference is and can always mutually be made to the individual aspects of the present invention concerning the disclosure.

A blower filter system according to the present invention has a blower filter device with a blower, with a filter mount and with a tube connection for connecting a respirator device by means of a tube. A blower filter system according to the present invention is characterized in that the filter mount is designed for receiving a filter, on which a color coding with a color specific to a parameter of the filter, especially of the pneumatic resistance of the filter, is arranged. Furthermore, the blower filter device has an optical sensor device for recognizing different colors of the color coding.

The color coding makes it consequently possible to code a parameter specific to the filter. These are defined especially as blower-relevant parameters. Such a parameter consequently affects the manner of functioning of the blower. Due to such a parameter being known, the blower and the regulation of the blower can thus be adapted. Besides the speed of rotation, another characteristic or another preset volume flow may also be used to regulate the blower. In particular, the color of the color coding codes the pneumatic resistance of the filter.

The color of the color coding is especially exactly one color or essentially exactly one color. However, different colors may, in principle, also be used in a common color coding, which may be arranged, for example, next to each other. The reading of such different colors can be carried out with the same common sensor device or also with different sensor devices. In particular, different color positions are used for different parameters for coding them. Thus, additional parameters, especially blower-relevant parameters, can also be made available in a color coding or in color codings arranged next to each other in an inventive manner.

The combination of different colors in one color coding may also be specific to a parameter, especially the pneumatic resistance.

Compared to prior-art blower filter systems, direct reading of the pneumatic resistance of the filter can now be performed. In other words, a real initial (basic-fresh) pneumatic resistance of the filter can now be used as the basis for the calculation in a control unit of the blower filter system, which is designed (configured) to determine and/or calculate the residual capacity of the filter. The real overall capacity-based on the difference between the pneumatic resistance and the maximum performance capacity of the blower—is used to determine and/or calculate the residual capacity of the filter. In the example described in the introduction of this application, the color coding by the optical sensor device of such a control unit would furnish the information that the filter has a pneumatic resistance of about 7 mbar, for example, in the empty and still unloaded state. Likewise, the maximum blower capacity of about 10 mbar is stored in the control unit, so that a difference can be calculated, which, equaling approx. 3 mbar, can be attributed to the filter as an overall capacity. The calculation of the residual capacity is now based on this difference between the pneumatic resistance and the maximum performance capacity of the blower, which difference is generally available as a maximum. The residual capacity is correspondingly determined and displayed according to the present invention as a real residual capacity that is specific to the particular filter without distortion. This leads to a markedly more accurate and especially undistorted display of the residual capacity and hence to increased acceptance by the user. In particular, it is achieved in this manner that a possible incorrect treatment of filters, in the form of filters incorrectly defined as rejects, is avoided.

The design of the filter mount in the manner according to the present invention shall be defined such that a geometric correlation of the filter mount and the filter is defined in relation to one another by these two components. Thus, the filter mount may have, e.g., thread means or snap-locking means in order to position and/or fasten the filter in a defined relative position in relation to the blower filter device. Due to this defined relative position, the color coding also has a defined relative position. In particular, this defined relative positioning shall be defined as a defined relative position in relation to the optical sensor device. Thus, by inserting and fastening the filter in the filter mount, the color coding is arranged quasi automatically at a position at which the optical sensor device can also perform the recognition of this color coding. Even if the filter has not yet been inserted into the filter mount, the filter mount has corresponding fastening and/or positioning means, which will automatically bring the color coding of the filter into the desired relative position when the filter is inserted into the filter mount. The optical sensor device is arranged with a corresponding correlated relative position in the blower filter device and is designed for the corresponding recognition of the different colors of the color coding. The sensor device is consequently adapted to the type of the colors of the color coding, especially to the distinctiveness of different colors of the color coding for different pneumatic resistances of different filters.

In the systematics according to the present invention, different filters or different filter systems may, of course, also have the same color as a color coding if they have the same pneumatic resistance. Thus, different filters, which have a similar packing density and hence a similar or identical pneumatic resistance, may be used to filter different types of particles. It is thus seen that only a relatively small number of different colors is needed for the color coding even in case of a large number of a great variety of filters. In particular, it is possible to use color systems that have relatively great distances from one another in a corresponding color space. For example, 8 or 10 or a maximum of about 20 different colors are thus usually sufficient for the color coding of any desired variety of filters. The small number of different colors makes it possible to make especially great distances available from one another between the individual colors in a color space. It is thus ensured that an increased or improved accuracy is possible in recognizing the different colors by the optical sensor device. Possible tolerance inaccuracies in inserting the filter into the filter mount or possible variations in the quality of recognition by the optical sensor device are less significant or no longer significant due to the increased distance in the color space for the different colors of the color coding.

The pneumatic resistance of the filter is defined as the pressure loss definitely generated during the flow through this filter. This pressure loss depends on the mode of construction of the filter, especially on the packing density of the corresponding filter material. The more densely the filter is packed or the longer its flow section is, the higher will be the pneumatic resistance of such a filter. In other words, the higher the filter capacity, the denser will the packing need to be, and the higher will thus be the pneumatic resistance generated in the filter. This pneumatic resistance of the filter is decisive for the determination of the residual capacity. However, the type of the connected tube or the connected respirator device may additionally also be taken into account for the determination of the residual capacity of the filter.

It may be advantageous if the blower filter system has, especially in the blower filter device, a control unit, which is designed to determine the residual capacity. Moreover, a display device, e.g., in the form of a display, may, of course, also be arranged on the blower filter device to visually display the residual capacity for the user.

A decisive advantage besides the basic recognition of the design of the pneumatic resistance of the filter is the especially cost-effective manner in which it can be manufactured. Thus, the filter is usually a disposable material, which is designed for use in one shift or in one use situation of the blower filter system. The durations of the use of such filters are consequently in the range of one to several hours. The filter is subsequently disposed of as spent material and replaced with a new, fresh filter. Compared to coding systems that are otherwise possibly known, in the form of electronic labels, a blower filter system according to the present invention can make use of an especially cost-effective coding in the form of a color coding, which can be manufactured in a simple manner. Thus, the color codings may be printed or stuck on and entail hardly any costs in the manufacture and the coding of the particular filter. Thus, despite the filter being a disposable item, the color coding according to the present invention entails hardly any additional costs. Existing production systems can also continue to be used because of the simplicity of this color coding. Existing filters can, of course, also be retrofitted with color codings according to the present invention.

The optical sensor system is preferably designed with sensor means, which may be designed, e.g., as light transmitters, as light receivers and/or as light conductors. Thus, the optical sensor device brings with it sensor means that make possible the steps of recognition in a physical respect for the recognition of the color of the color coding. This is defined, on the one hand, as the recognition of a position in the color space and the intensity thereof, as well as the light conduction between the recognition means and the color coding. In particular, the physical concept of the reflection of light at the color coding is made use of.

It may be advantageous if a filter with a color coding with a color specific to the pneumatic resistance of the filter is mounted in the filter mount in a blower filter system according to the present invention. Such an embodiment consequently describes the situation in which a blower filter system according to the present invention is used. A respirator device is preferably also already connected to the tube port with a tube, so that the blower filter system is designed completed for use. The filter is disposable material in this case, which can be preferably replaced after a work shift of the user of the blower filter system. The individual filters represent a free state at the time of use, in which they are not yet clogged, i.e., they are unused. The residual capacity of the filter will decrease during the use of the blower filter system depending on the pollutant level in the air, and the filter will correspondingly become clogged with particles. The pneumatic resistance will increase due to the clogging, and a calculation of the decreasing residual capacities will become possible in the manner described.

It is likewise advantageous if the optical sensor device in the blower filter system according to the present invention has at least one light source for the emission of light and at least one light receiver for receiving reflected light. The light source is designed in an especially cost-effective manner, e.g., as an LED. The emission of light may be effected in a great variety of colors, especially with white light, as will be explained later. The light receiver is, e.g., a photoelectrically active element, which is capable of analyzing reflected light in terms of intensity and/or position in the color space. The optical sensor device thus becomes optically active itself, so that the optical sensor device can be used to recognize the color of the color coding regardless of an ambient situation. If, e.g., the color coding of the filter is in a sealed-off area with the filter mounted in the filter mount, no outside light will reach it. A defined surrounding area, which is dark or darkened in this case, is rather created, which provides a defined illumination situation of the color coding by the known manner of emitting light from the light source. Likewise, a basic characteristic of the reflection characteristics can be preset by the material, the arrangement and the surface of the color coding and stored, e.g., in a control unit of the blower filter system. The light receiver thus can take these basic optical parameters from the geometric factors and the reflection characteristics into account in the analysis of the received reflected light. This exact definition of the optical parameters leads to an even further increase in the exactness of the determination of the color coding. In particular, a greater tolerance capacity is achieved in this manner, so that the most accurate and error-free recognition possible of the color of the color coding is ensured even in case of inaccurate positioning of the filter in the filter mount in respect to geometric correlations. For example, the intensity of specific light can be perceived one after another by the light receiver in an RGB color spectrum. It is also possible that the light receiver has a more complex design in order to split the received reflected light in respect to its intensity into the individual color components.

Furthermore, it may be advantageous if the light source in a blower filter system according to the present invention is designed for the emission of white light, especially as an LED. An individual illuminating means will thus become possible in an especially cost-effective and simple manner in order to emit the light. The light receiver is preferably designed as an RGB color sensor in order to be able to split the received type of the reflected light into the individual primary colors and to specifically determine the particular intensity. Information on the mixed color can thus subsequently be made available to a control unit in order to make it possible to determine and especially calculate the actual color of the color coding. Such an embodiment has an especially cost-effective and simple design in respect to the light source. The step of determination can also be carried out especially rapidly, because only a single, short-term irradiation with white light and the corresponding reception of the reflection must be carried out. The light receiver is preferably designed as a broad-band sensor in this case.

According to an embodiment that is an alternative to the embodiment of the above paragraph, it is advantageous if the light source has at least three illuminating means with different light colors for the emission of light with different colors. Unlike in the embodiment according to the above paragraph, this makes it possible to use the three primary colors, e.g., as an illuminating means. The light receiver can preferably be manufactured in a more cost-effective manner, because it is no longer necessary to split the reflected light into the individual primary colors. Due to the irradiation with three different colors sequentially, i.e., one after another, it is rather possible to effect a splitting of the reflected light directly into the respective light components. Thus, this splitting is carried out optically and it does not have to be effected later by electronic analysis. A simpler and faster embodiment of the sensor as a light receiver is possible in this manner. The amount of calculations needed will also be reduced, so that more cost-effective and simpler control or analysis units will be able to be used.

It is likewise advantageous if the filters that can be mounted in the filter mount in a blower filter system according to the present invention have different colors each, and the different colors are essentially located essentially equidistantly and especially exactly equidistantly from one another in a color space. A color space is, e.g., the so-called RGB color space (Red/Green/Blue). A color space consequently exactly defines a color mixture of a color, especially in a three-dimensional manner by three position coordinates. If different colors are used for different pneumatic resistances of different filters, any desired color can be selected in a first step for the color of the particular color coding. To ensure that an especially accurate and rapid analysis of the correct color of the color coding is effected by the optical sensor device, the distance between the individual different colors is, however, selected to be especially great. The distance in the color space between the different colors selected is preferably essentially equal for all colors used of a color coding system, so that the recognition of the different colors concerning their distinctiveness entails the same effectiveness and hence the same safety for all different colors of the color system of the color codings. The accuracy of recognition is thus increased and the susceptibility to errors is reduced. The accuracy of recognition is thus affected only slightly if at all in an optical sensor device according to the present invention especially in case of geometric tolerance errors made when inserting the filter in the filter mount.

Furthermore, it is advantageous if the optical sensor device in a blower filter system according to the present invention has at least one light conductor, which is designed to conduct light in the direction of the color coding. Such a light conductor is made, e.g., of a plastic material or a glass fiber material and is constructed especially as a so-called TIR (Total Internal Reflection) body. It has an input surface and an output surface, so that the light emitted by the light source can be coupled in via the input surface and decoupled via the output surface. Other optical means, such as lenses, reflectors or diaphragms, may also be made available as additional components of the optical sensor device. The light conductors are used to offer greater simplicity and more freedom in arranging the optical sensor device, especially the individual sensor means. Different numbers of light conductors may be provided. A Y-shaped branching of a light conductor is also possible in order to achieve a further cost reduction and reduction in the number of components.

It is likewise advantageous if the blower filter device in a blower filter system according to the present invention has a tube recognition device for recognizing a tube connected to the tube port. Tubes are usually specific to the particular respirator device. Consequently, there is a specific tube, e.g., for a breathing mask, and another specific tube, e.g., for a respirator hood. However, all types of tubes, which are specific to the particular respirator device, have one and the same mechanical interface to the respective tube port of the blower filter device. The tube recognition device is preferably likewise designed as an automated device, and it recognizes the particular respirator device being used at present from the specific type of tube. Since the particular respirator device also entails a specific pneumatic resistance, a tube recognition device according to the present invention leads to a further improvement of the display of the residual capacity and of the determination of the particular residual capacity. Different pneumatic resistances of different respirator devices can thus likewise be taken into account now on the basis of the specific tube when determining the residual capacity.

It may be advantageous in a blower filter system according to the above paragraph if the tube recognition device is likewise designed as an optical sensor device for recognizing different colors of a tube color coding, which is arranged on a tube with a color specific to the type of the tube and hence of the pneumatic resistance. The described quality according to the present invention can thus also be applied to a tube recognition device. The same design possibilities that were explained in the preceding paragraphs can thus also be used for the tube and the tube recognition device. The tube recognition device preferably has independent and separate sensor means, i.e., a light transmitter of its own and a light receiver of its own. In particular, the particular color coding of the tube is ring-shaped in such an embodiment in order to make it possible to guarantee free rotatability of the tube on the tube port and to make at the same time a spot monitoring by means of the optical sensor device possible. It is ensured, depending on the rotation position, that it is always possible to determine the color of the color coding by an correlation of the position in relation to the optical sensor device of the tube recognition device in case of a ring-shaped design of the tube color coding.

It may also be advantageous if the tube recognition device is designed in a blower filter system, as an alternative to the preceding paragraph, as an electronic sensor device for reading an electronic label, especially an RFID label, in respect to a pneumatic resistance, which is arranged in the tube. Contrary to the filter, the tube is usually not a disposable object, but it may be used over many uses. A more cost-effective solution with an RFID label can thus be used here as well. In particular, the RFID label or the electronic label is arranged in the area of the coupling on the inner side thereof for protection against mechanical effect or unintended removal.

Another subject of the present invention is a filter for insertion and use in a filter mount of a blower filter device of a blower filter system, especially according to the present invention. Such a filter is characterized in that a color coding with a color specific to the pneumatic resistance of the filter is arranged on a surface of the filter. Thus, especially due to the use of a blower filter system according to the present invention, a filter according to the present invention offers the same advantages as they were explained in detail in reference to the blower filter system according to the present invention. The filter may have the particular embodiments as they were likewise described in reference to the blower filter system according to the present invention. The filter is usually a disposable material, which is removed after one shift of use in a shift-based use and is replaced with a new filter. The recognition of the color of the color coding is thus effected each time after the filter is replaced in the blower filter system. As was already explained, a color coding is an especially cost-effective solution for coding the pneumatic resistance of the filter. Thus, already existing filters or filter systems can thus also be retrofitted with the color coding quality according to the present invention.

It may be advantageous if the specific color of the color coding in a filter according to the present invention can be obtained by subtractive color mixing. This leads to an especially cost-effective design of the color coding, because simple standard coloring agents can be used to produce the color mixture. Such color systems are also available at a reasonable cost and, moreover, can be defined unambiguously concerning a three-dimensional color space in connection with the recognition of the color of the color coding. Thus, such a selection leads not only to reduced manufacturing costs of the color coding, but also to simplified analysis and hence to a reduction of the cost of the construction of the optical sensor device of the blower filter system.

It is likewise advantageous if the color coding is designed as an adhesive label in a filter according to the present invention and is arranged on the surface of the filter. As was already mentioned, already existing filters can also be retrofitted in this manner with the quality according to the present invention. The adhesive labels can be printed in a cost-effective and simple manner and then attached simply by sticking. As an alternative, it is, of course, also possible that the color coding is printed directly on the filter during the manufacture thereof. The colored design of a part of the housing of the filter or of a part of the filter surface is also possible through such a design. The entire filter surface may also be colored in order to make a corresponding color coding available. In particular, it is advantageous if the color coding is attached to the filter irreversibly or if the filter contains the color coding in an irreversible manner if high level of safety shall be attained. An undesired incorrect pairing of an incorrect color of the color coding with a filter is thus avoided more reliably. The attachment should be performed such as to ensure the smallest possible geometric extension of the color coding in order to compromise the effective filter surface as little as possible.

It may likewise be advantageous if the surface of the color coding in a filter according to the present invention is designed, at least in some sections, for a diffuse reflection characteristic, especially with a rough and/or coated surface. As was explained above, the analysis is performed with an optical sensor device especially with the light reflected by the color coding. Since the direction of reflection is determined by the geometric correlation between the filter and the filter mount, geometric tolerance inaccuracies may develop.

However, since the position of the optical sensor device, especially of a light source and of a light receiver, relative to the filter mount is defined unambiguously, a different reflection situation may possibly develop due to a variation of the reflection surfaces and of the reflection characteristics. It is ensured by diffuse reflection characteristics that a reflection characteristic can be assumed that also always brings a certain amount of reflection to the particular light receiver independently and hence free from tolerances or with reduced tolerance. This diffuse tolerance characteristic does not consequently bring mirroring reflection with it, but a diffuse reflection in many different directions. Such a diffuse reflection characteristic is made available, e.g., by a rough/textured and/or coated surface.

It is likewise advantageous if the color coding on the filter is of a circular or essentially circular shape in a filter according to the present invention. The center of the circular arrangement is arranged on or in the area of the axis of rotation of the filter. An identical design of the color coding may also be used as a tube color coding for coding a tube and a corresponding tube recognition device. An additional rotator degree of freedom is thus obtained, which maintains the necessary geometric correlation between the color coding and the optical sensor device even in case of rotation of the filter in the filter mount. Consequently, free rotatability is achieved, as a result of which especially a more cost-effective and simple design of the positioning means of the filter mount can be attained.

The present invention also pertains to a method for determining the pneumatic resistance of a blower filter system according to the present invention, having the following steps:

Determination of the color of the color coding of a filter inserted into the filter mount, Comparison of the color determined with a stored color chart, in which a pneumatic resistance each is assigned to the colors, Use of the pneumatic resistance obtained from the comparison for determining the residual capacity.

A blower filter system according to the present invention preferably already has a control unit, which is configurable for such a method. The optical sensor device can thus be made use of for determining the color of the color coding. A color chart, in which an exact pneumatic resistance belonging to a particular color is assigned to each color, may be stored in such a control unit. This defined pneumatic resistance is used as a function of the determined color in order to carry out the determination of the residual capacity realistically and as error-free as possible. Thus, a method according to the present invention offers the same advantages as those explained in detail in reference to a blower system according to the present invention Further advantages, features and details of the present invention appear from the following description, in which exemplary embodiments of the present invention are described in detail with reference to the drawings. The features mentioned in the claims and in the description may be essential for the present invention each individually in itself or in any desired combination. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
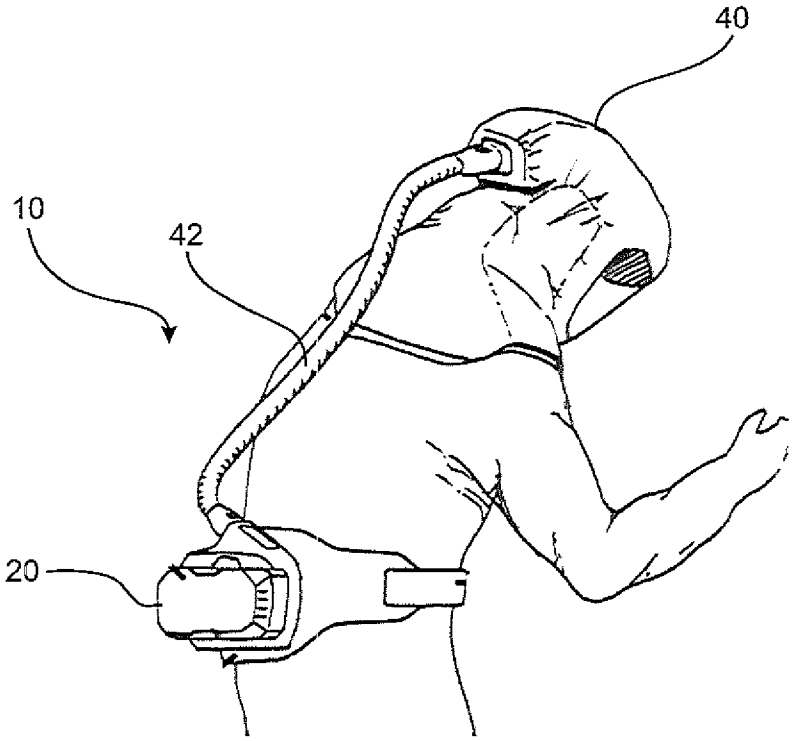
FIG. 1 is a perspective view showing a blower filter system according to the present invention during use.

FIG. 1 schematically shows an embodiment of a blower filter system 10 according to the present invention during use. The person carries as a respirator device 40 a respirator hood, which is connected to the blower filter device 20 via a tube 42. Only filtered air is sent during this use into the respirator device 40 via the filter 30 and a blower 22 through the tube 42.

Figure 2:
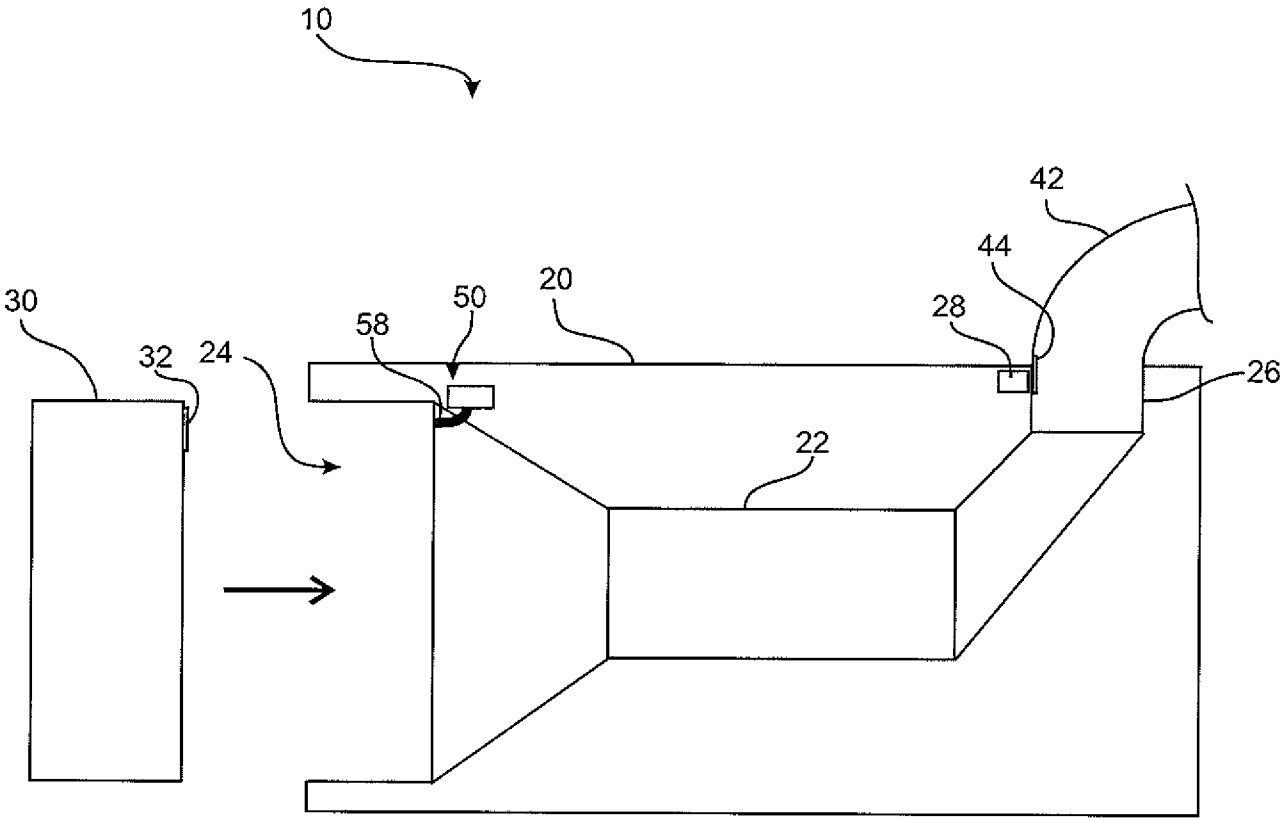
FIG. 2 is a schematic view of an embodiment of a blower filter system according to the present invention with the filter to be inserted.
Figure 3:
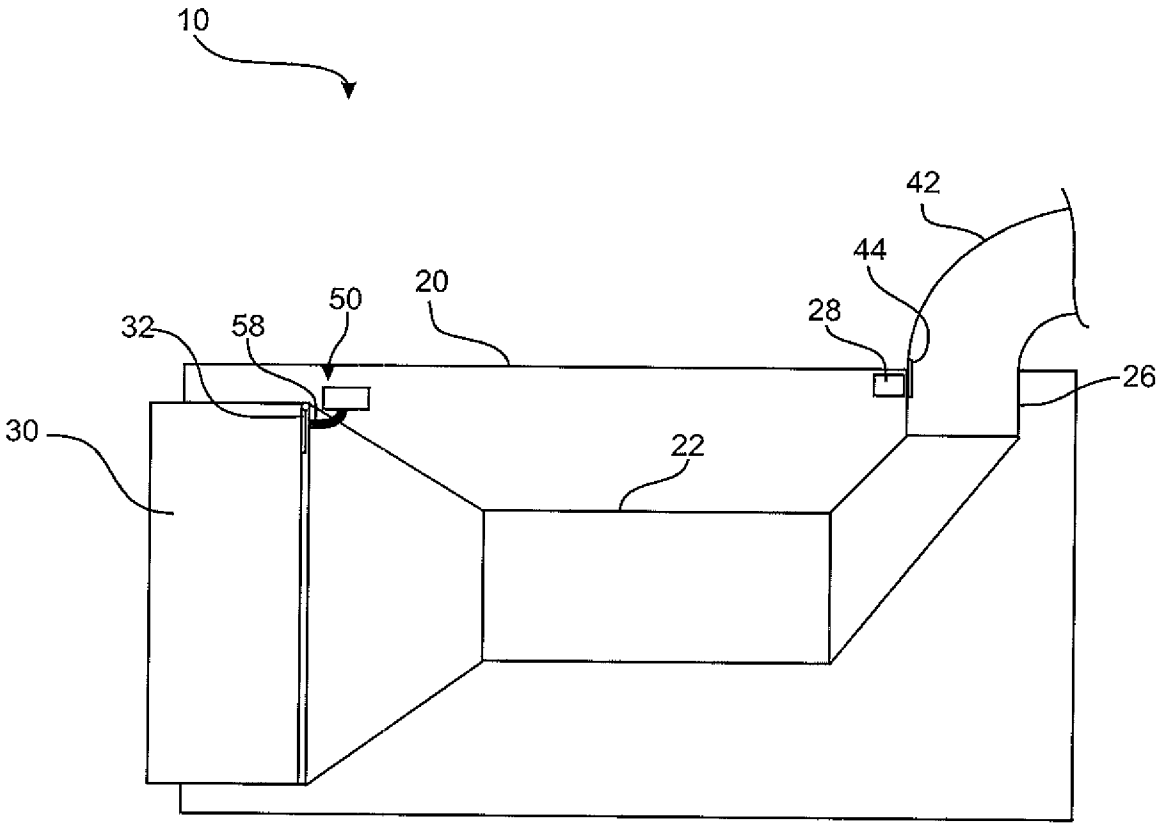
FIG. 3 is a schematic view of the embodiment according to FIG. 2 with the filter inserted.

FIGS. 2 and 3 schematically show how a blower filter system 10 according to the present invention may be designed. Thus, the blower filter system 10 has a blower filter device 20 with a centrally arranged blower 22. This blower 22 delivers a defined volume flow from left to right in FIGS. 2 and 3 in a controlled and regulated manner via a characteristic curve control, e.g., with a control unit 51. On the left, the blower filter device 20 has a filter mount 24, into which the filter 30 can be inserted along the direction of the arrow according to FIG. 2. A tube port 26, into which the tube 42 of a respirator device 40 is plugged, is provided at the upper right-hand end.

It can be clearly seen in FIG. 3 that with the filter 30 inserted, an exact relative positioning of the color coding 32 of the filter 30 in relation to an optical sensor device 50 of the blower filter system 10 has been effected. Recognition of the color of the color coding 32 is possible now via a light conductor 58.

Based on the recognition of the color of the color coding 32, an analysis can be carried out via the color chart and the pneumatic resistance of the filter 30 can thus be assigned to the mounted filter. A residual capacity is determined based on this pneumatic resistance. The residual capacity is determined based on an overall capacity, which can be determined as a difference between the basic (initial or fresh) pneumatic resistance and the maximum blower capacity of the blower 22. The residual capacity is thus stated markedly more accurately, particularly displayed relative to the overall capacity, and the provision or display of the residual capacity ensures, especially error-free, an increased acceptance by the user of the blower filter system 10.

It can also be seen in FIGS. 2 and 3 that a tube recognition device 28 is provided in the area of the tube port 26. This device 28 is designed for the determination of an electronic reading of an electronic label 44 on the tube 42. Since the tube 42 is a reusable component, increased costs for the electronic design of the tube recognition device and the corresponding electronic label 44 are markedly less significant with respect to the tube 42.

Figure 4:
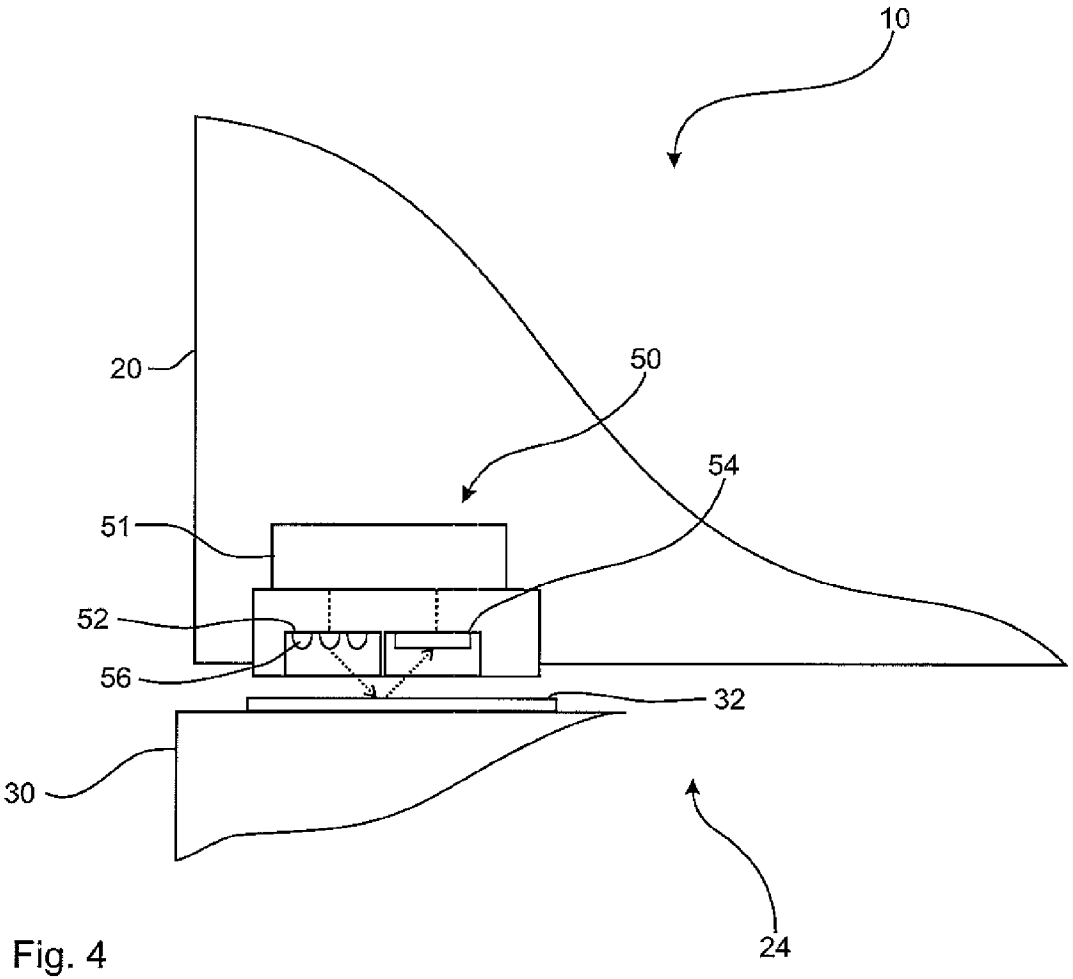
FIG. 4 is a schematic view of an embodiment of a blower filter system according to the present invention.

FIG. 4 shows a possible embodiment of an optical sensor device 50, which is arranged in the blower filter device 20. The individual sensor means are designed as a light source 52 and as a light receiver 54 according to an embodiment. The light source 52 has three individual illuminating means 56, which emit light of different colors according to this embodiment, especially according to the three basic colors. The optical path lengths are indicated by arrows in broken lines, so that the emission of the light takes place in the direction of the color coding 32 of the filter 30. Reflection takes place on the color coding 32, especially diffusely, so that emitted light is emitted back in the direction of the light receiver 54. A control unit 51, which is connected to the individual sensor means, i.e., the light source 52 and the light receiver 54, in a signal-communicating manner is also shown schematically. The control unit 51 performs the determination and especially also the analysis concerning the residual capacity, particularly based on a real initial (basic-fresh) pneumatic resistance of the filter as the basis for the calculation. The control unit 51 is designed (configured) to determine and/or calculate the residual capacity of the filter based on the real overall capacity-based on the difference between the pneumatic resistance and the maximum performance capacity of the blower.

Figure 6:
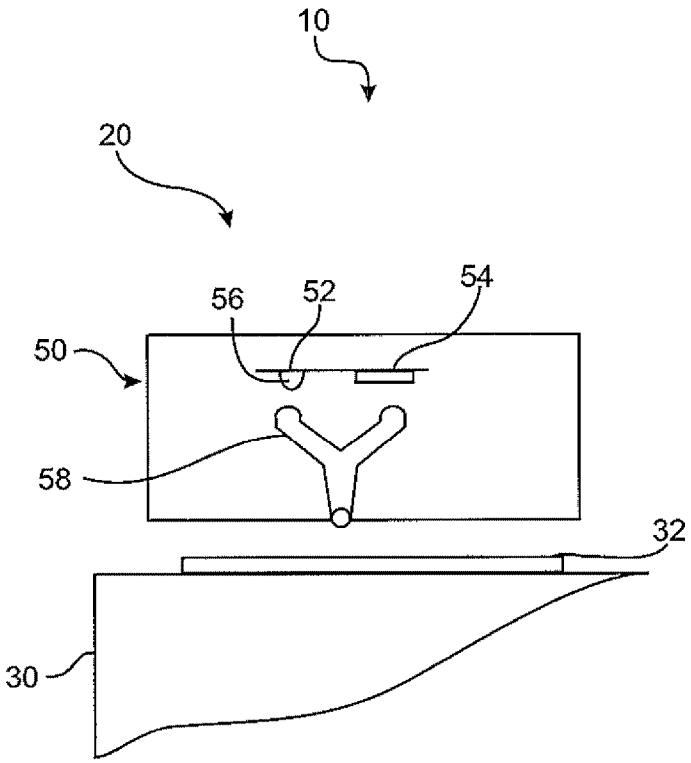
FIG. 6 is a schematic view of another embodiment of an optical sensor device.
Figure 5:
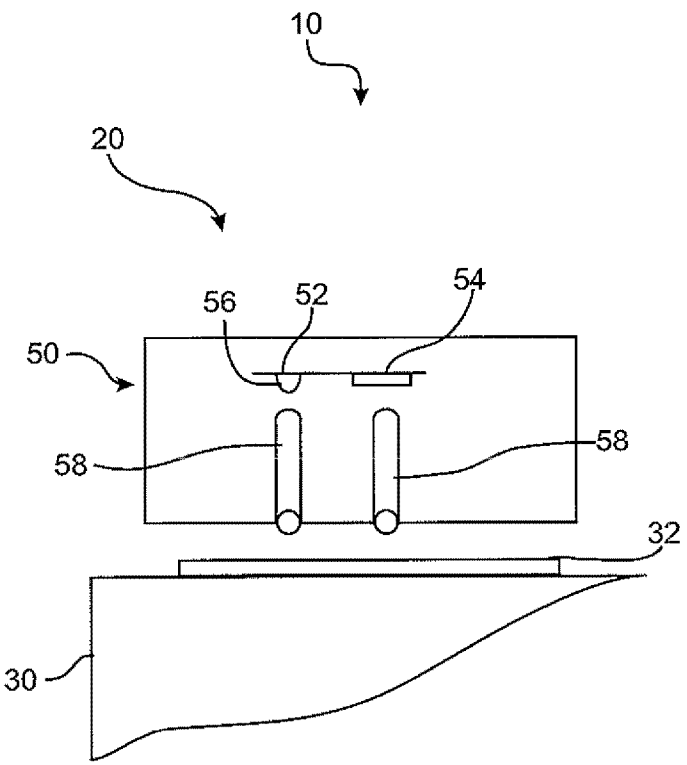
FIG. 5 is a schematic view of an embodiment of an optical sensor device.

FIGS. 5 and 6 show two different embodiments of optical sensor devices 50. It is common to both embodiments that light conductors 58 are used here. These two optical sensor devices 50 also have an individual light source 52 each with a single illuminating means 56 in the form of a white LED. The light receiver 54 has a more complex design here in order to make it possible to split the reflected white light into the individual color components and to determine a defined position in a three-dimensional color space. The two embodiments differ in the type of the light conductor 58. Thus, the provision of two separate and essentially cylindrical light conductors 58 is provided according to the embodiment of FIG. 5. These can be positioned in an especially cost-effective and simple manner. However, Y-shaped branches of the light conductor 58 may also be used in case of complex space situations and in crowded spaces, as this is shown, e.g., in FIG. 6.

Figure 7:
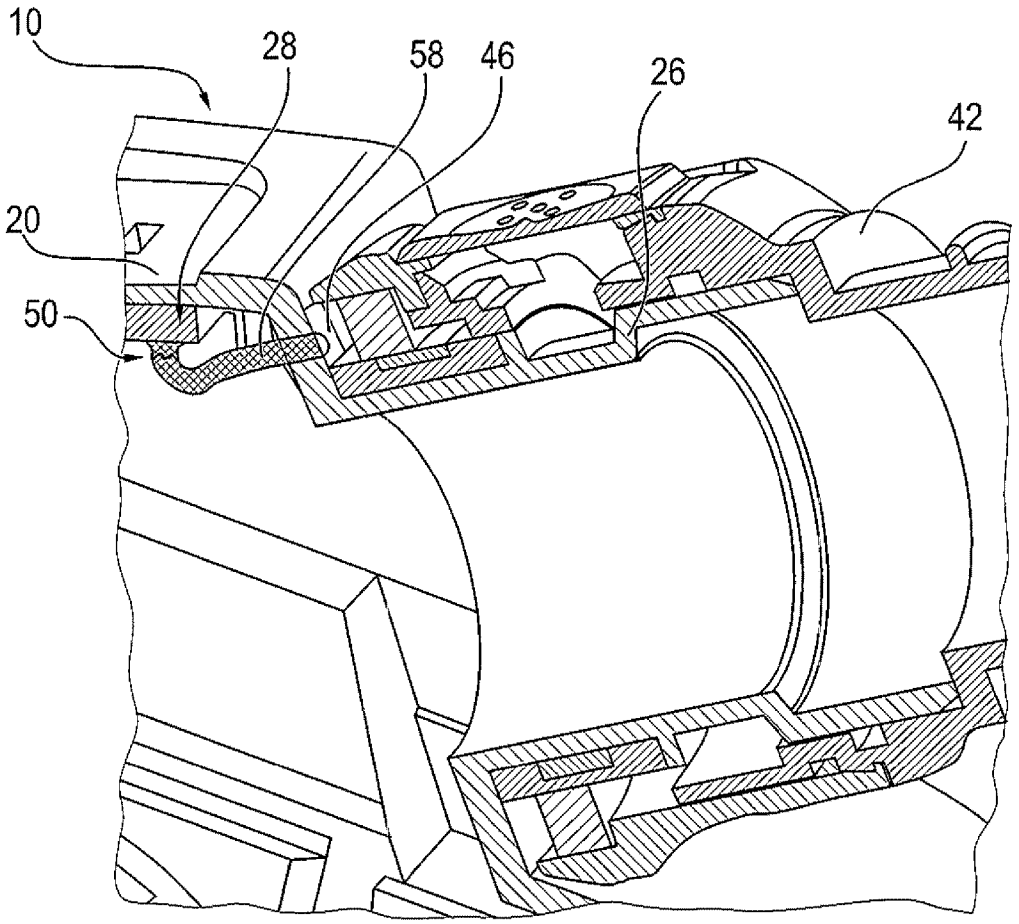
FIG. 7 is an embodiment of a tube recognition device.
Figure 8:
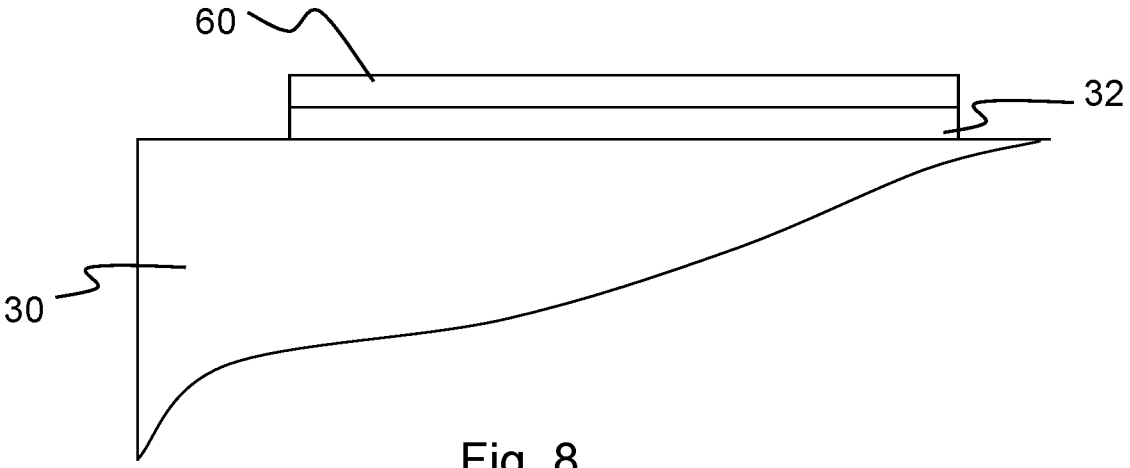
FIG. 8 is a schematic view of an embodiment of a blower filter according to the present invention.

FIG. 7 schematically shows another embodiment of a tube recognition device 28 according to the present invention. This is likewise designed as an optical sensor device with a light conductor 58 and correspondingly has the same functionality. The tube 42 is fastened to the tube port 26 via a mechanical interface and has a tube color coding 46 at its end. This color coding 46 is ring-shaped according to this embodiment, so that a geometric position correlation is always guaranteed between the light conductor 58 and hence the optical sensor device 50 and the tube color coding 46 even in case of free rotation of the tube 42. FIG. 8 shows an embodiment of the filter 30 with the color coding 32 having a diffuse reflection characteristic comprised of a rough and/or coated surface 60.

The above explanation of the embodiments describes the present invention exclusively within the framework of examples. Individual features of the embodiments, insofar as technically meaningful, may, of course, be freely combined with one another without going beyond the scope of the present invention.

While specific embodiments of the invention have been shown and described in detail to illustrate the application of the principles of the invention, it will be understood that the invention may be embodied otherwise without departing from such principles.

The invention claimed is:

1. A blower filter system comprising a blower filter device, the blower filter device comprising:

a blower;

a filter mount;

a tube port for connecting a respirator device by a tube, the filter mount being configured to receive a filter, on which a color coding with a color specific to a parameter of the filter is arranged;

an optical sensor device positioned relative to the filter mount for recognizing different colors of the color coding and determining the color of the color coding of the filter inserted in the filter mount; and a control unit connected to the optical sensor and configured to compare the color determined by the optical sensor with a stored color chart, in which stored color chart an initial pneumatic resistance is assigned to each of a plurality of colors, to obtain the initial pneumatic resistance of the filter inserted in the filter mount and to calculate a residual capacity of the filter, wherein an initial pneumatic resistance of the filter obtained from the comparison, from the recognized color specific to the parameter of the filter, is used as the basis for the calculation of residual capacity of the filter, wherein the calculation of the residual capacity of the filter is based on a difference between the initial pneumatic resistance of the filter obtained from the comparison, from the recognized color specific to the parameter of the filter, and a maximum blower capacity of the blower.

2. The blower filter system in accordance with claim 1, further comprising the filter, with the color coding with a color specific to a pneumatic resistance of the filter, the filter being mounted in the filter mount.

3. The blower filter system in accordance with claim 1, wherein the optical sensor device comprises at least one light source for emitting light and at least one light receiver for receiving reflected light.

4. The blower filter system in accordance with claim 3, wherein the light source is configured to emit white light, as an LED.

5. The blower filter system in accordance with claim 3, wherein the light source has at least three illuminating means with different light colors for the emission of lights of different colors.

6. The blower filter system in accordance with claim 2, further comprising additional filters, wherein the filters, which are mountable in the filter mount, have a color coding, with different colors for each, wherein the different colors are spaced at essentially equal distances from one another in a color space.

7. The blower filter system in accordance with claim 1, wherein the optical sensor device has at least one light conductor, which is designed for conducting light in the direction of the color coding.

8. The blower filter system in accordance with claim 1, wherein the blower filter device further comprises a tube recognition device for recognizing a tube type or for recognition of the tube connected to the tube port, which said type is specific to a pneumatic resistance.

9. The blower filter system in accordance with claim 8, wherein the tube recognition device comprises a tube optical sensor device for recognizing different colors of a tube color coding, which is arranged on a tube with a color specific to the type of the tube and the pneumatic resistance thereof.

10. The blower filter system in accordance with claim 8, wherein the tube recognition device comprises an electronic sensor device for reading an RFID label, the RFID label indicating the tube type that is specific to the pneumatic resistance, which said label is arranged on the tube.

11. A method for determining a pneumatic resistance of a blower filter system the method comprising the steps of:

providing a blower filter device comprising: a blower; a filter mount; a tube port for connecting a respirator device to the blower filter device by a tube, the filter mount having a filter receiving area, an optical sensor device, and a control unit connected to the optical sensor and configured to compare the color determined by the optical sensor with a stored color chart, in which stored color chart an initial pneumatic resistance is assigned to each of a plurality of colors, to obtain the initial pneumatic resistance of the filter inserted in the filter mount and to calculate a residual capacity of the filter;

providing at least one filter having a color coding, with a color specific to the an initial pneumatic resistance of the filter, arranged on a surface of the filter;

inserting a provided filter in the filter mount;

recognizing colors of the color coding with the optical sensor device and determining the color of the color coding of the filter inserted in the filter mount;

comparing the color determined with a stored color chart, in which stored color chart a pneumatic resistance is assigned to each of a plurality of colors, to obtain the initial pneumatic resistance of the filter inserted in the filter mount; and determining a residual capacity of the filter based on the initial pneumatic resistance obtained from the comparison, wherein the calculation of the residual capacity of the filter is based on a difference between the initial pneumatic resistance of the filter obtained from the comparison, from the recognized color specific to the parameter of the filter, and a maximum blower capacity of the blower.

12. The method in accordance with claim 11, further providing the blower filter with a control unit and wherein the step of determining a residual capacity of the filter comprises the control unit calculating, wherein the calculating is based on an initial pneumatic resistance of the filter.

13. The method in accordance with claim 11, wherein the optical sensor device determines the color of the color coding and the optical sensor device comprises at least one light source for emitting light and at least one light receiver for receiving reflected light.

14. The method in accordance with claim 11, further comprising the step of providing additional filters, wherein any one of the filters can be mounted in the filter mount and each filter has the color coding with each being a different color, wherein the different colors are spaced at essentially equal distances from one another in a color space.

* * * * *